United States Patent [19]

Nonini et al.

[11] Patent Number: 4,982,935

[45] Date of Patent: Jan. 8, 1991

[54] MULTIPURPOSE ROD COOLING LINE

[75] Inventors: Geremia Nonini, Buttrio; Wogler D. Ruzza, Udine, both of Italy

[73] Assignee: Danieli & C. Officine Meccaniche SpA, Buttrio, Italy

[21] Appl. No.: 472,811

[22] Filed: Jan. 31, 1990

[30] Foreign Application Priority Data

Feb. 13, 1989 [IT] Italy ..... 83325 A/89

[51] Int. Cl.[5] ..... B21B 43/00; B21B 45/02; C21D 9/52

[52] U.S. Cl. ..... 266/106; 72/201; 140/2

[58] Field of Search ..... 72/200, 201, 202; 140/2; 266/106

[56] References Cited

U.S. PATENT DOCUMENTS

| | | | |
|---|---|---|---|
| 3,490,500 | 1/1970 | Dopper et al. | 266/106 X |
| 3,711,918 | 1/1973 | Shore | 140/2 X |
| 3,770,025 | 11/1973 | Hirschfelder et al. | 140/2 |
| 4,054,276 | 10/1977 | Wilson | 266/106 |
| 4,242,153 | 12/1980 | Vitelli et al. | 266/106 X |
| 4,310,031 | 1/1982 | Appel et al. | 266/106 X |
| 4,320,646 | 3/1982 | Bindernagel et al. | 72/201 |
| 4,807,457 | 2/1989 | Polino et al. | 72/201 X |

*Primary Examiner*—E. Michael Combs

*Attorney, Agent, or Firm*—Antonelli, Terry, Stout & Kraus

[57] ABSTRACT

Multipurpose cooling line to process equally well either steel with a low content of carbon, or equivalent, or steel with a high content of carbon, or equivalent, the line including a roller conveyor (12) downstream of a coil-winder machine (11) to wind wire rod, the roller conveyor (12) comprising forced draught means (13) and an insulation hood (14) and being dimensioned to cool steel coils (15) having a high content of carbon, the terminal portion of the roller conveyor (12) including a first delivery station (28) and a second successive, neighbouring delivery station (29), the first delivery station (28) cooperating with a first pit (18) containing a first coil collection unit (23), while the second delivery station (29) cooperates with a second delivery pit (21) containing a second coil collection unit (22), the first delivery station (21) being located within the insulation hood (14), while the second delivery station (29) is located outside, and on the same axis as, the hood (14).

5 Claims, 1 Drawing Sheet

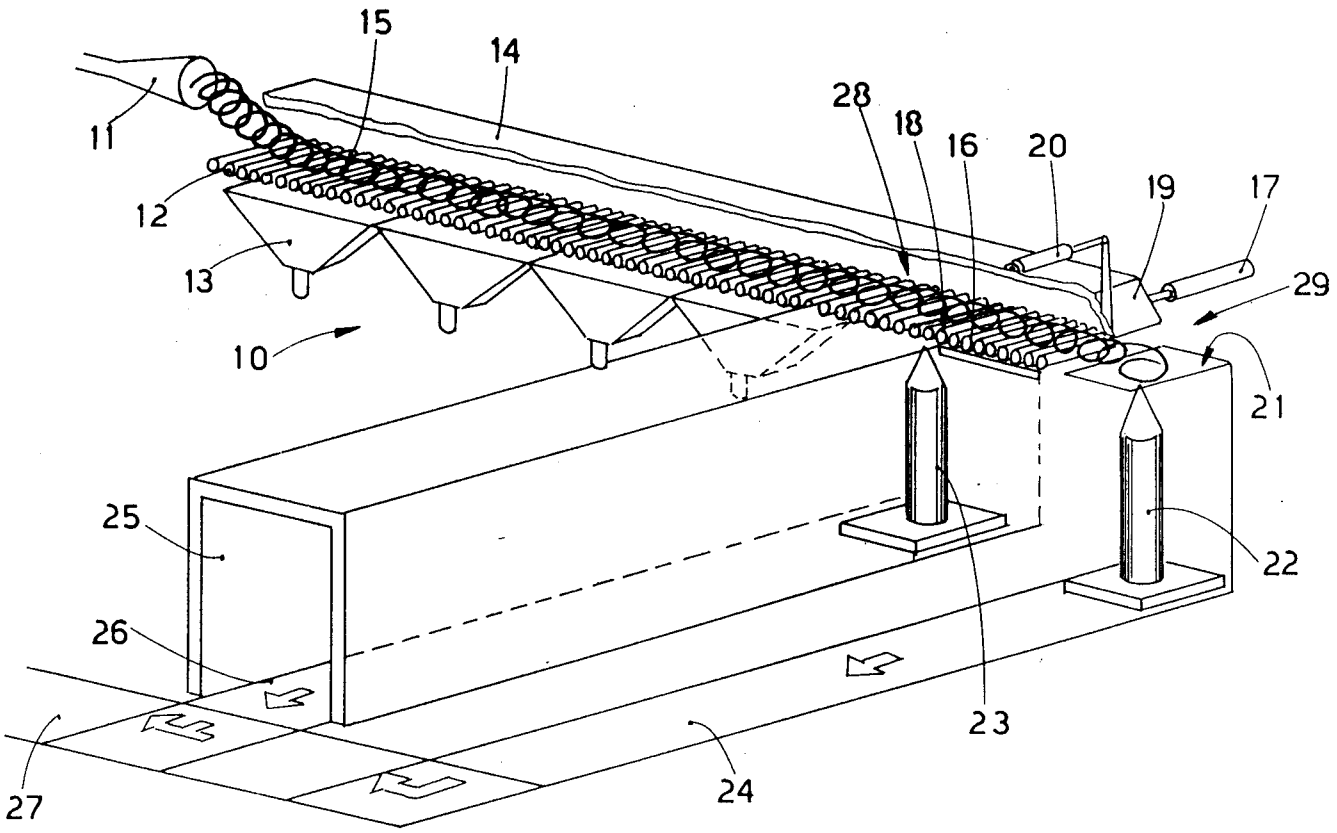
29
17
21
22
19
20
16
23
18
28
24
14
15
10
13
12
11
25
26
27

MULTIPURPOSE ROD COOLING LINE

BACKGROUND OF THE INVENTION

This invention concerns a multipurpose cooling line for rolled wire or wire rod leaving a coil-winder machine able to serve the whole range of wires to be wound in bundles, whether the wires are made of steel with a high content of carbon, or equivalent or of steel with a low content of carbon, or equivalent.

Rolling plants which process wire rod comprise at their end one or more coil-forming headstocks that serve their own cooling line, which includes at its end one or more reels to collect the coils in bundles.

At the present time, to cool the coils of wire rod coming from a coil-forming headstock or coil-winder machine processing steel coils with a high content of carbon, or equivalent, the coils are lapped with a flow of forced draft that removes the heat in the coils at about 25°-30° C. a second. Instead, when it is necessary to cool steel with a low content of carbon, or equivalent, the cooling of the coils takes place in a screened manner, normally by employing insulation hoods, so that the cooling does not exceed 0.4°-0.5° C. a second.

Therefore, when steel with a low content of carbon is cooled, the stay time is very long and therefore the length of the cooling line is very long.

GB-A-2,120,589 discloses a plant to cool coils. This plant comprises terminally a series of particular reception means, which lie on a conveyor line, and one or another of them is included at a single position for discharge of cooled coils. This document does not teach the provision of means for controlled cooling of the loose coils nor of stabilization means in line with the coiled bundles. It provides containers to gather the bundles in an insulated environment, but these containers are themselves insulated, are installed on conveyor means and entail the known problems of transferring the coils into the container so as to form a bundle. Moreover, the conveyor means move on runways, with the relative transfer problems and can carry only a limited number of containers and cannot be used on runways lying at 90° to each other.

DE-A-No. 3.020.229 teaches only the provision of a casing for the controlled cooling of coils being cooled.

SUMMARY OF THE INVENTION

So as to reduce the length of the roller cooling conveyor and therefore to compact the whole cooling line and, at the same time, to enable the steel with a high content of carbon or a low content of carbon to be cooled, the present applicant has designed, tested and embodied this invention.

The invention relates to a multipurpose cooling line to process equally well steel with a low content of carbon, or equivalent, or steel with a high content of carbon, or equivalent. The cooling includes a roller conveyor downstream of a coil-winder machine to wind wire rod. The roller conveyor includes forced draft means and an insulation hood and is dimensioned to cool steel coils having a high content of carbon. The terminal portion of the roller conveyor includes a first delivery station and a second successive, neighboring delivery station, the first delivery station cooperating with the first pit containing a first coil collection unit, while the second delivery station cooperates with a second delivery pit containing a second coil collection unit. First delivery station is located within the insulation hood, while the second delivery station is located outside, and on the same axis as, the hood.

According to the present invention a multipurpose cooling line comprises a known, normal roller conveyor positioned downstream of a coil-winder machine.

This roller conveyor includes known insulation hood means to control the cooling; these means can be actuated when so desired, and therefore this roller conveyor can also cool steel having a high carbon content.

The roller conveyor comprises terminally a first coil delivery station cooperating with a first coil collection unit with a reel to form wound bundles.

Next, the roller conveyor includes immediately downstream of the first coil delivery station a second delivery station cooperating with a second coil collection unit with a reel to form wound bundles.

The roller conveyor is therefore of a type suitable to provide a controlled cooling with a slow removal of heat and suitable for steel with a low content of carbon and also a powerful cooling of a type suitable for steel with a high content of carbon and capable of being insulated when necessary.

The first coil collection unit cooperates with the first delivery station at the end of the roller conveyor, whereas the second coil collection unit is positioned immediately downstream of the first coil collection unit and cooperates with the first delivery station.

The first coil collection unit transfers the wound bundles into an insulated tunnel kept at a temperature between 80° and 100° C. and advantageously at about 90° C., so that the wound bundles of wire rod collected by the first coil collection unit pass through this tunnel at a relatively low speed thus making possible a very slow, controlled drop in temperature which entails a required, controlled cooling of wound bundles of wire rod having a low content of carbon.

This makes possible a controlled heat exchange in a bundle of coils by means of a cooling line at least 50% shorter than the present cooling lines for steel having a low content of carbon. Instead the second coil collection unit delivers the wound bundles to a normal discharge conveyor.

BRIEF DESCRIPTION OF THE DRAWINGS

The attached FIGURE, which is given as a non-restrictive example, shows a three-dimensional diagram of an embodiment of the invention.

DETAILED DESCRIPTION OF THE PREFERRED EMBODIMENTS

A coil-winder machine 11 located upstream of a cooling line 10 lays continuously on a roller conveyor 12 a plurality of coils 15 which are fed along the roller conveyor 12.

The roller conveyor 12 comprises in its lower part some fans 13 to provide a forced cooling draft and an insulation hood 14 on its upper part.

The fans 13 are actuated when the coils 15 are made of steel with a high content of carbon; in these circumstances the insulation hood 14 is opened or lifted to permit a fast flow of the air thrust by the fans 13.

The insulation hood 14 can not only be opened or lifted for a fast flow of air according to the invention but also comprises at least one door 19 which remains closed when the steel with a low content of carbon is being processed.

This terminal door 19 can be opened, for instance by a jack 20 to facilitate the passage of coils 15 when these coils are made of steel with a high content of carbon and are taken up by a second coil collection unit 22.

A first coil delivery station or position 28 and a second coil delivery station or position 29 are included at the end of the roller conveyor 12.

First 23 and second 22 coil collection units cooperate with the first 28 and second 29 delivery stations and comprise reels to wind coils for the formation of wound bundles.

The first delivery station 28 is positioned within the hood 14, so that the first coil collection unit 23 remains in an insulated environment.

The second coil collection unit 22 cooperates with the outside of the hood 14 since the second delivery station 29 is outside the hood 14.

A first pit 18 to accommodate the first coil collection unit 23 cooperates with the first delivery station 28, while a second pit 21 to accommodate the second coil collection unit 22 cooperates with the second delivery station 29.

The coil collection units 22–23 may be stationary or be of a movable type so as to be discharged with the bundles they contain and to be replaced by other like collection units not containing bundles.

When the second delivery station 29 is in use, movable rollers 16 cover the first pit 18 within which the first coil collection unit 23 is accommodated in a receiving position, thus making possible the continuity of the roller conveyor 12 and practically eliminating the first delivery station 28.

These movable rollers 16 are positioned in a first position to cover the first pit 18 and in a second retracted position to leave the first pit 18 open by means of a cylinder/piston actuator 17 or an analogous means.

The second coil collection unit 22 is positioned in the second pit 21 and cooperates with the second delivery station 29.

An insulated tunnel 25 within which the wound bundles of coils are passed is included in cooperation with the first pit 18 and therefore with the first coil collection unit 23.

A first conveyor belt 26 to convey the first coil collection unit 23 cooperates with the insulated tunnel 25, while a second conveyor belt 24 cooperates with the second coil collection unit 22.

The second conveyor belt 24 may be parallel to the insulated tunnel 25; if so a third common receipt conveyor 27 may be provided.

We claim:

1. A multipurpose cooling line for processing equally well either steel of low carbon content or steel of high carbon content, comprising:

a coil-winding means to wind steel wire rod to form steel coils;

a roller conveyor positioned downstream of said coil-winding means and having a longitudinally extending axis;

forced draft means for cooling steel coils having a high carbon content, said forced draft means being operably connected to said roller conveyor and positioned along said longitudinally extending axis thereof;

a longitudinally extending insulation hood operable between open and closed positions, said closed position being such that an axis of said longitudinally extending hood is above and parallel to said longitudinally extending axis of said roller conveyor;

a first delivery station provided under a downstream portion of said roller conveyor, said downstream portion of said roller conveyor being located under a downstream portion of said insulation hood when said insulation hood is in a closed position, said downstream portion of said roller including movable rollers operable between an open position providing access to said first delivery station and a closed position covering and closing said first delivery station;

a second delivery station provided at a terminal end of said roller conveyor downstream of said first delivery station, said terminal end being located outside of said insulation hood; and first and second delivery pits containing first and second coil collection units, respectively, and cooperating with said first and second delivery stations, respectively.

2. A multipurpose cooling line according to claim 1, further comprising first and second conveyor means cooperating with said first and second delivery pits, respectively, for conveying coils from said first and second coil collection units, respectively.

3. A multipurpose cooling line according to claim 2, wherein said first and second conveyor means are substantially parallel to one another.

4. A multipurpose cooling line according to claim 2, wherein said first delivery pit, first coil collection unit and first conveyor means cooperate with an insulated tunnel within which said first conveyor means extends.

5. A multipurpose cooling line according to claim 2, wherein said first and second conveyor means each has a longitudinally extending axis not parallel to the longitudinally extending axis of said roller conveyor.

* * * * *